US010197308B2

(12) United States Patent
Moreno Valdes et al.

(10) Patent No.: US 10,197,308 B2
(45) Date of Patent: Feb. 5, 2019

(54) PORTABLE SELF-REFRIGERATING AUTONOMOUS SYSTEM

(71) Applicants: Enrique Javier Moreno Valdes, Seville (ES); Emilio Palomo Pinto, Seville (ES)

(72) Inventors: Enrique Javier Moreno Valdes, Seville (ES); Emilio Palomo Pinto, Seville (ES)

( * ) Notice: Subject to any disclaimer, the term of this patent is extended or adjusted under 35 U.S.C. 154(b) by 368 days.

(21) Appl. No.: 14/778,563

(22) PCT Filed: Mar. 20, 2014

(86) PCT No.: PCT/ES2014/007028
§ 371 (c)(1),
(2) Date: Sep. 18, 2015

(87) PCT Pub. No.: WO2014/147281
PCT Pub. Date: Sep. 25, 2014

(65) Prior Publication Data

US 2016/0282020 A1 Sep. 29, 2016

(30) Foreign Application Priority Data

Mar. 20, 2013 (ES) ..... 201300295

(51) Int. Cl.
*F25B 19/00* (2006.01)
*F25D 3/10* (2006.01)
(Continued)

(52) U.S. Cl.
CPC ..... *F25B 19/005* (2013.01); *F25B 41/067* (2013.01); *F25B 43/003* (2013.01);
(Continued)

(58) Field of Classification Search
CPC ..... F25B 19/005; F25B 40/00; F25B 49/00; F25B 43/003; F25B 2700/197;
(Continued)

(56) References Cited

U.S. PATENT DOCUMENTS 4,361,013 A * 11/1982 Skeele ..... F25D 3/107 62/223
5,101,637 A * 4/1992 Daily ..... B01D 8/00 62/292
(Continued)

FOREIGN PATENT DOCUMENTS

GB 2313436 A 11/1997

OTHER PUBLICATIONS

International Search Report dated May 13, 2014 for PCT/E52014/070208.

*Primary Examiner* — Brian M King
(74) *Attorney, Agent, or Firm* — Knobbe, Martens, Olson & Bear, LLP

(57) ABSTRACT

A portable self-refrigerating autonomous system comprises a leak-tight tank in which a pressurized liquefied gas is stored, at least one evaporation control valve and a filling valve, all the valves being connected to the leak-tight tank. The at least one evaporation control valve also cooperates with a temperature and/or pressure sensor, and an actuator is intended for controlling the opening of the at least one evaporation control valve.

14 Claims, 15 Drawing Sheets

(51) Int. Cl.

| | |
|---|---|
| ***F25B 41/06*** | (2006.01) |
| ***F25B 43/00*** | (2006.01) |
| ***F25B 45/00*** | (2006.01) |
| ***F25B 49/00*** | (2006.01) |
| ***F25D 31/00*** | (2006.01) |

(52) U.S. Cl.
CPC ..... *F25B 45/00* (2013.01); *F25B 49/00* (2013.01); *F25D 3/10* (2013.01); *F25D 31/007* (2013.01); *F25D 31/008* (2013.01); *F25B 2600/2525* (2013.01); *F25B 2700/04* (2013.01); *F25B 2700/197* (2013.01); *F25B 2700/2117* (2013.01)

(58) Field of Classification Search
CPC ..... F25B 2700/04; F25B 2700/2117; F25B 2600/2525
See application file for complete search history.

(56) References Cited

U.S. PATENT DOCUMENTS

| | | | |
|---|---|---|---|
| 6,389,839 | B1 | 5/2002 | Sabin |
| 2002/0116942 | A1 | 8/2002 | Suh |

* cited by examiner

PORTABLE SELF-REFRIGERATING AUTONOMOUS SYSTEM

CROSS REFERENCE TO RELATED APPLICATIONS

This application is the U.S. National Phase of International Application No. PCT/ES2014/070208, filed March 20, 2014, designating the U.S. and published in Spanish as WO 2014/147281 on Sep. 25, 2014 which claims the benefit of Spain Patent Application No. P201300295, filed Mar. 20, 2013. Any and all applications for which a foreign or domestic priority claim is identified here or in the Application Data Sheet as filed with the present application are hereby incorporated by reference under 37 CFR 1.57.

TECHNICAL FIELD

The invention is comprised in the refrigerating sector based on PLG evaporation, more specifically, in the solutions which allow, through this technology, considerable portability and usability for refrigerating liquids, agri-foods, drugs, various sanitary uses and any other use, system or element, requiring forced refrigeration.

DESCRIPTION OF RELATED ART

PLG evaporation, among other solutions, is applied in refrigerating systems today for industrial freezing, this technology providing different solutions for achieving said refrigerating. The following references are examples:

Patent document ES 2 048 312 is based on the technique of spraying PLG directly on the substance to be cooled, and a quick freeze state of the substance to be frozen is achieved as a result of the immediate evaporation of PLG. This system is normally used in food tunnel freezers.

Another application for PLG evaporation as a refrigerating element is based on the technique of immersing the substance to be cooled in PLG, using a leak-tight container. By causing refrigeration by means of the sudden release of PLG and as a result of the heat of vaporization, a refrigerating effect is achieved, as mentioned in patent document ES 2 098 281 T3.

Another application for the use of PLG used as a refrigerating source, in this case using $CO_2$, consists of producing fine particles of snow in a liquid carbon dioxide stream, as mentioned in patent document ES 2 256 904 T3.

Due to the associated cost, the most common conservation system during transport is use of dry ice, introducing the substance to be conserved in a container that is thermally insulated against the exterior. The main drawback of said system is the low refrigerating power of ice (so a large amount of ice must be carried around, which entails more weight).

Patent document ES 200 50 44 A6 is indicated as a sample of this solution, in this case applied to food logistics, and is based on the instant production of carbon dioxide snow and the use thereof in insulated railway containers.

Application of the PLG evaporation technique has been developed very little within the sector of portable and mobile refrigerating systems.

The solutions referred to in such patent documents are not optimal for portability and/or for the outputs provided with respect to the manual transport of small cold systems, and therefore with respect to the degree of usability and autonomy with respect to the source of energy thereof for application to these tasks.

SUMMARY

A first object of the present invention consists of a portable self-refrigerating autonomous system according to claim 1 and depicted in FIG. 1.

More particularly, said portable self-refrigerating autonomous system comprises a leak-tight tank in which a pressurized liquefied gas (PLG) is stored, at least one evaporation control valve and a filling valve, all the valves being connected to the leak-tight tank; said portable self-refrigerating autonomous system furthermore being characterized in that:

Said at least one evaporation control valve cooperates with a temperature and/or pressure sensor and an actuator intended for controlling the opening of said evaporation control valve, such that the level of opening of the evaporation control valve (or, in other words, the PLG evaporation level) which the actuator allows depends directly on the pressure and/or temperature detected by said sensor, thereby controlling the pressure and the internal temperature in the leak-tight tank.

Preferably, if the portable self-refrigerating autonomous system comprises more than one control valve, the filling valve and said control valves are arranged in series on one and the same conduit or adapter. On the other hand, the actuator of the at least one control valve can be electromagnetic, electronic, pneumatic or mechanical.

The portable self-refrigerating autonomous system according to the invention is characterized by its autonomy with respect to the source of energy and its portability, the technological solution of which is based on the use of a leak-tight tank (2) made of a material having high thermal conductivity, loaded with PLG (1) and used as a vaporizer. Cold generation and diffusion is achieved in an optimal manner as a result of the controlled evaporation of PLG (1) contained in said tank (2), and as a result of the application of a system for controlling gasification of the refrigerant (in this case, PLG). This cold that is generated can be transferred by thermal conduction or convection directly from the leak-tight tank (2).

The portable self-refrigerating autonomous system according to the invention is preferably though not exclusively applied to refrigerating solids and liquids that must be kept within a given temperature range.

The portable self-refrigerating autonomous system according to the invention also has good autonomy characteristics with respect to the source of energy, portability and control of the PLG load consumption, in addition to a sufficient degree of temperature control, so that portable and reduced-size applications can be developed as a result of the simplicity of the design and its higher output.

The system stands out for how cost-effective it is, the simplicity of its manufacture, and its operating reliability as a result of the limited number of components it comprises.

The preceding objects and advantages of the invention will be more evident based on the following description in reference to the attached drawings. However, it must be understood that the drawings are for illustrative purposes only and are not intended to define the limits of the invention.

DETAILED DESCRIPTION OF CERTAIN EMBODIMENTS

Figure 1:
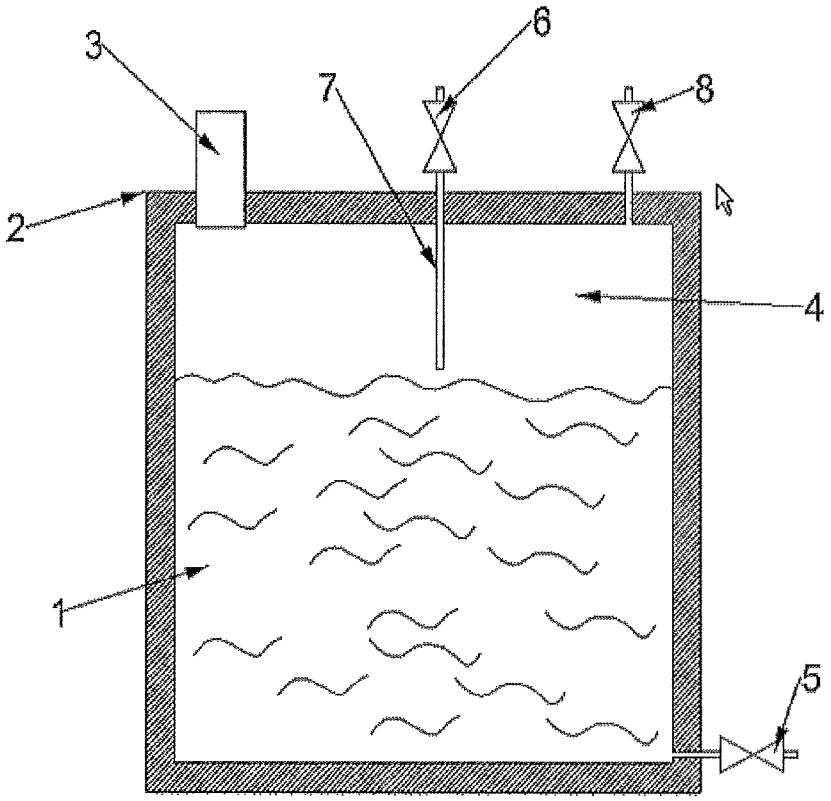
FIG. 1 shows a schematic depiction of the leak-tight tank loaded with pressurized liquefied gas, in addition to the loading system and the evaporation control system.

As shown in FIG. 1, the system proposed in this invention is based on the use of a leak-tight tank (2) manufactured from a material having high thermal conductivity and on the controlled evaporation of a PLG (1) contained in said tank (2). This leak-tight tank (2) will perform a vaporizer function because, due to thermal conduction, the cold that is generated by the evaporation of PLG (1) is transmitted to the leak-tight tank (2), and from there to the exterior. This vaporization is regulated and therefore optimized as a result of using control solutions through valves (3, 5, 7 and 9). A portable refrigerating autonomous system is thereby achieved.

The system according to the present invention can be applied for refrigerating solids and liquids that must be kept in a given temperature range. Said system consists of a leak-tight tank (2) in which a pressurized liquefied gas (PLG) (1) is stored, one or more evaporation control valves (3) and a filling valve (5), both valves (3, 5) being connected to the leak-tight tank (2), characterized in that said leak-tight tank (2) works like a vaporizer as a result of the action of said evaporation control valve or valves (3), arranged in series if there are more than one, controlling evaporation of the PLG cooling the tank (2), and thereby controlling the pressure and internal temperature in the tank; the control exerted by said evaporation valve or valves (3) is performed from a temperature or pressure sensor and an electromagnetic, electronic, pneumatic or mechanical actuator.

Through physics, it is well known that when a PLG (1) evaporates, a refrigerating effect is produced that is used commercially, for example, for cryogenic systems. The present invention seeks to optimize use of this refrigerating effect for portable uses. To that end, a system has been developed where by control over the evaporation of said PLG (1) is achieved. Said system consists of a leak-tight tank (2) that can be refilled. Said tank (2) is provided with an evaporation control valve (3) that is operated as a result of the temperature of this leak-tight tank (2). The opening control for said valve (3) can be performed by a mechanical, electromagnetic or hydraulic actuator (mechanical control is depicted in the case of the example of the invention). This control is based on the principle that vapor pressure of PLG (1) drops at a lower temperature, and the valve (3) therefore closes to prevent the evaporation of PLG (1). Once the temperature of the leak-tight tank (2) increases, the internal pressure will also increase proportionally, making the aforementioned valve (3) open. When said valve (3) opens, the pressurized liquefied gas (1) begins the process of evaporation (4) due to the difference in pressure between the outside of the leak-tight tank (2) and the inner area thereof in which the gas (4) evaporates, also called PLG gaseous area, thereby producing the refrigerating effect that is sought. As a result of this system, a temperature that is adjusted and dependent on the calibration of said evaporation control valve (3) is achieved, thereby consuming only the required amount of PLG (1) in order to reach the desired temperature. This system therefore achieves greater optimization and the subsequent savings in the load of PLG (1), and therefore the consumption required for the refrigerating process. This allows developing applications that are easy and inexpensive to manufacture, characterized by their high degree of portability.

Figure 20:
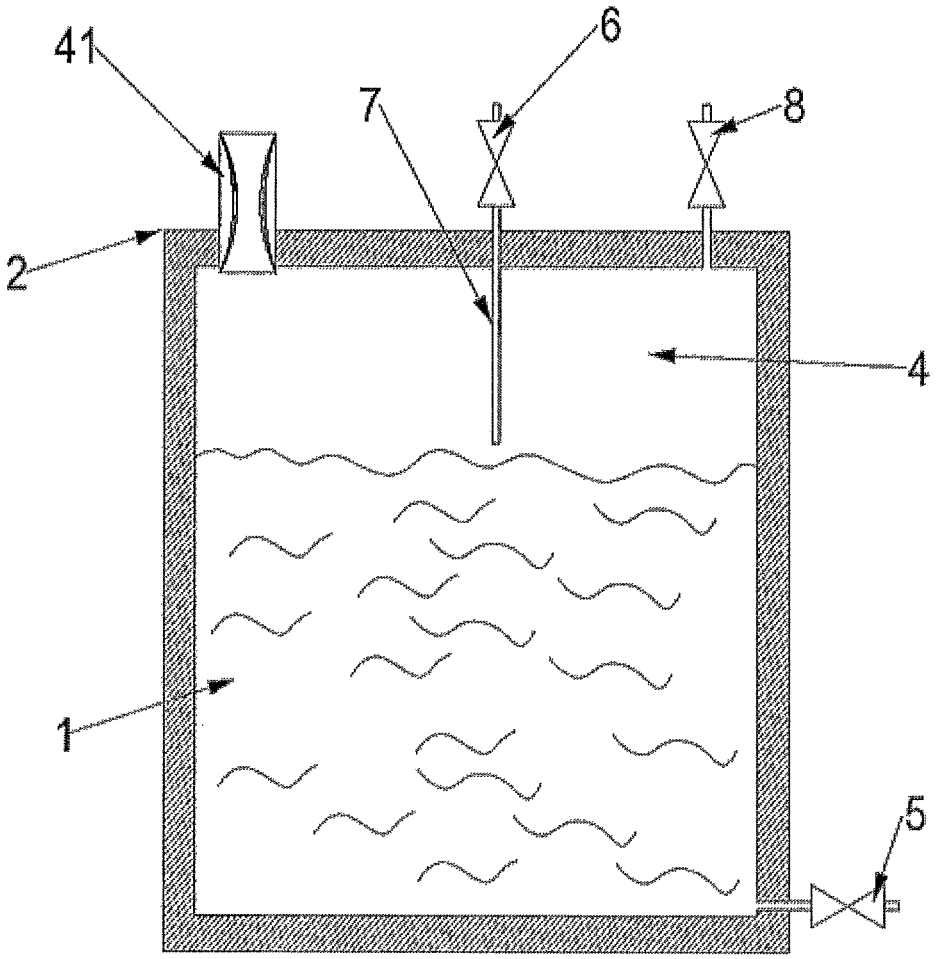
FIG. 20 shows a schematic depiction of the leak-tight tank loaded with pressurized liquefied gas, in addition to the loading system and the evaporation control system for control through a capillary tube.

The evaporation control valve (3) can be replaced with a capillary tube (41), as shown in FIG. 20).

The general operation of the portable refrigerating system according to the invention as depicted in FIG. 1 consists of a leak-tight tank (2) filled with PLG (1). The PLG can be any of the non-toxic substances conventionally used for this type of applications, such as fluorocarbon (Freon R, duPont), carbon dioxide, methyl chloride, etc.

A series of elements which will allow system operation are connected to the leak-tight tank (2), namely:

A filling valve (5) used for introducing the PLG.

A discharge control valve (6) and a tube (7) having a given length connected to one another. Said tube (7) is connected in turn to the leak-tight tank (2). The function of this component is to facilitate filling up to the loading value.

A purge or forced refrigeration start-up valve (8) which allows rapid cooling of the loading performed and the purging of residual evaporated gas (4).

Pressure valve for controlling temperature through evaporation control (3). This valve regulates the outlet of the evaporated gas according to the temperature sought for the compartment leak-tight.

The operating process of the portable self-refrigerating autonomous system according to the invention is as follows:

The process of loading PLG (1) in liquid form is performed through the filling valve (5). Once the filling valve (5) opens, loading of the PLG (1) in the leak-tight tank (2) begins. The PLG (1) starts to enter until the pressures that exist between the leak-tight tank (2) and the external PLG source balance out. In this case, the leak-tight tank (2) is not filled up to its loading value because the internal pressure of the leak-tight tank (2) does not allow PLG to enter from the external source. At this point the discharge control valve (6) opens, and therefore there will be a difference in pressure between the inside of the leak-tight tank (2) and the PLG source (15). Since the pressure of the leak-tight tank (2) is less than the pressure of the PLG source (15), the leak-tight tank (2) will continue to be filled up to the height of the tube (7) having a given length. When the PLG comes out through the discharge control valve (6) in liquid form, it will indicate that the PLG has filled the leak-tight tank (2) up to its optimal loading value and the discharge control valve (6) will close. Filling said leak-tight tank (2) without using external energy or prior cooling of the leak-tight tank (2) for there to be a difference in pressure due to the principle of communicating vessels is therefore allowed. In turn, for the sake of safety, tanks containing PLG must not be filled completely with liquid, leaving same space inside the tank (2) functioning as a chamber keeping some of the PLG in gaseous state (4).

The purge valve (8), previously also referred to as forced refrigeration valve, is used for the purpose of achieving an initial cold situation. When said valve is open, PLG is allowed to freely exit in gas form, and sudden cooling of the leak-tight tank (2) is therefore achieved. Once the desired temperature is reached, a refill up to the optimal level is performed because the PLG source (15) connected to the filling valve (5) is available. Therefore, once the leak-tight tank (2) is loaded, an initial cold situation will be generated and loading the PLG (1) will therefore take longer.

Evaporation and therefore temperature control of the leak-tight tank (2) is achieved through the evaporation control valve (3). This control is based on the principle that vapor pressure of PLG decreases at a lower temperature, and internal pressure in the gaseous area (4) of the PLG (1) which is contained in the leak-tight tank (2) therefore decreases. In this case, the pressure control valve (3) closes, preventing the evaporation of PLG (1). Once the temperature of the leak-tight tank (2) increases, the internal pressure in the gaseous area (4) of the PLG (1) that is contained in the leak-tight tank (2) will also increase proportionally, making the aforementioned valve (3) open. When said valve (3) opens, PLG (1) begins the process of evaporation due to the difference in pressure between the outside of the leak-tight tank (2) and the inside. When PLG (1) evaporates, it takes heat from its environment, achieving the refrigerating effect that is sought.

If desired, said evaporation could be controlled by electric or electronic means or through temperature valves.

Figure 2:
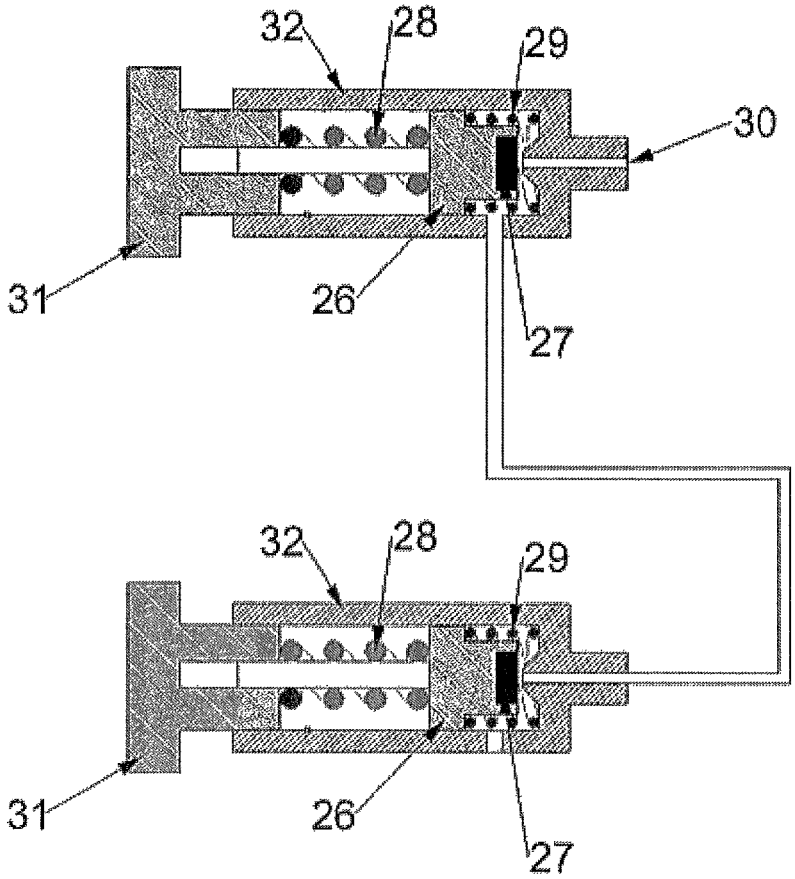
FIG. 2 shows the shutting off and interconnection of the evaporation control valves.

As an example of a temperature controlling pressure (or evaporation control) valve (3), FIG. 2 shows a longitudinal section of said valve which is provided with a spring (28) applying pressure on a plunger (26), the latter being provided with an elastomer (27) which closes a nozzle (30) that is interconnected with the leak-tight tank (2) to keep it closed when said tank (2) is at the working temperature and pressure. Said nozzle 30 is provided with a spring (29) applying minor pressure to the other spring (28), which is in the opposition position. The pressure applied by the plunger (26) on the elastomer (27) is determined by the pressure of the spring (28), which can be modified by the more or less movement of the threaded part (31) on the body (32) of the valve (3). This configuration provides an all or nothing operation depending on the pressure and temperature of the tank (2). The valve can be built with different mechanical, electric or electronic configurations provided that it respects the described operation.

For greater control of pressure and therefore temperature, several evaporation control valves (3) can be arranged in series (FIG. 2). One would be the main valve and the rest secondary valves, such that the outlet of the first evaporation control valve (3) will be connected to the inlet of the next one. This configuration allows controlling the initial pressure with the first valve and a fine adjustment with the next one.

In the case of using carbon dioxide as pressurized liquefied gas, the loading method can be modified to fill the leak-tight tank or evaporator (2) with carbon dioxide snow instead of liquid carbon dioxide. This means that the leak-tight tank does not have to have great mechanical strength because the pressures it must withstand will be lower. The method is as follows:

The process of loading PLG (1) in liquid form is performed through the filling valve (5). Once the filling valve (5) opens, loading of the PLG (1) in the leak-tight tank (2) begins. The PLG (1) starts to enter until the pressures that exist between the leak-tight tank (2) and the external PLG source (15) balance out. In this case, the leak-tight tank (2) is not filled up to its loading value because the internal pressure of the leak-tight tank (2) does not allow PLG (1) to enter from the external source. At this point the discharge control valve (6) opens, and therefore there will be a difference in pressure between the inside of the leak-tight tank (2) and the PLG source (15). Since the pressure of the leak-tight tank (2) is less than the pressure of the PLG source (15), the leak-tight tank (2) will continue to be filled up to the height of the tube (7) having a given length. When the PLG comes out through the discharge control valve (6) in liquid form (or in snow form), it will indicate that the PLG (1) has filled the leak-tight tank (2) up to its optimal loading value. Once the liquid (or snow) starts to come out, said discharge control valve (6) will be kept open. The gas outlet is limited by the section or adjustment of said discharge control valve (6). It can also be limited by the placement of a capillary tube at the outlet thereof, thereby preventing the free outlet of carbon dioxide. Sudden cooling of the leak-tight tank takes place as the gas exits, being able to reach the point where carbon dioxide goes from its liquid state to its solid state. The discharge control valve (6) will close when the carbon dioxide solidification temperature is reached and the leak-tight tank (2) is full. Taking into account that the triple point of carbon dioxide is-56.6° C. and 5.185 bar, the leak-tight tank (2) can be built such that it must withstand only said pressure, a very low initial temperature being achieved.

In order for there to be greater temperature transfer between the PLG (1) and the leak-tight tank (2), and therefore optimization of the system, the leak-tight tank or evaporator (2) can internally be provided with a variety of fins (9). Since there is a larger internal surface of contact, there will be greater temperature transfer between the PLG (1) and the leak-tight tank (2).

Figure 3:
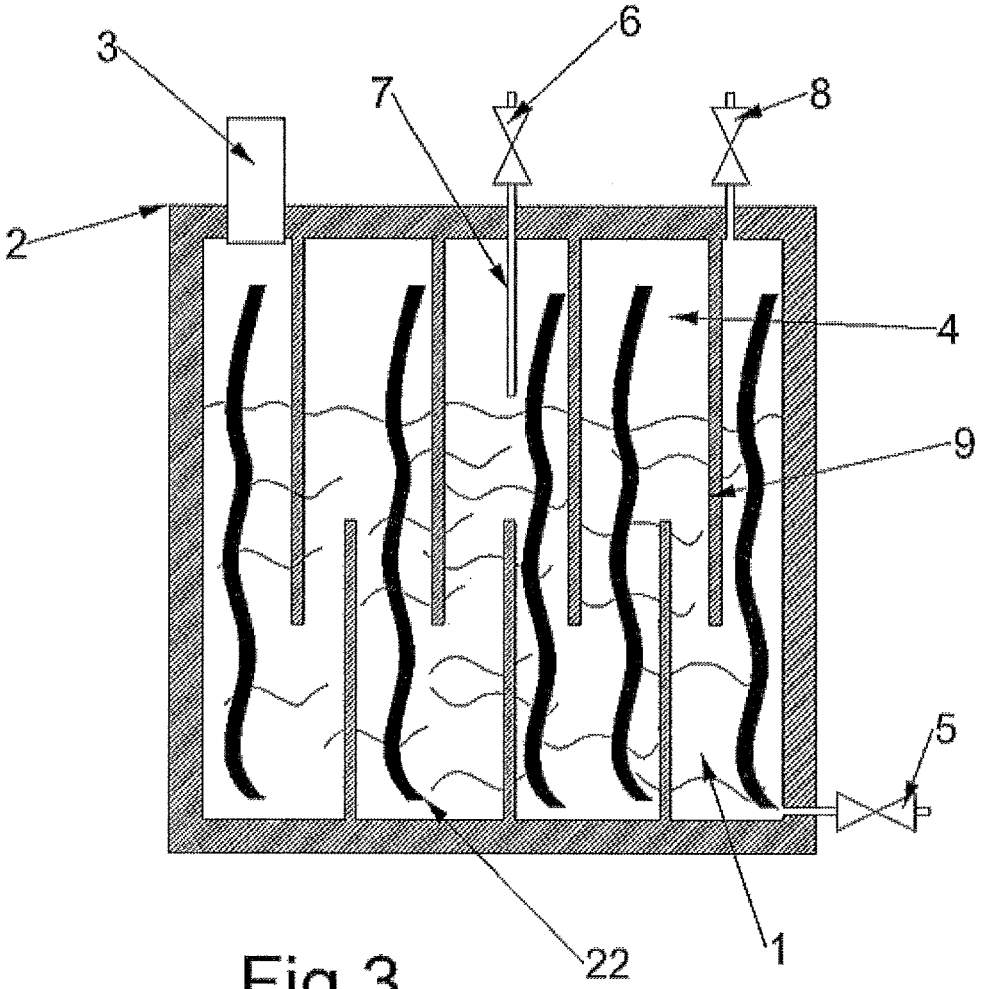
FIG. 3 shows a schematic depiction of the leak-tight tank loaded with pressurized liquefied gas, the loading and evaporation control system, and systems for improving temperature transmission between the PLG and the leak-tight tank.

The temperature transfer between the PLG (1) and the leak-tight tank (2) can also be produced by the use of a mesh or foam (22) manufactured with a material having a high coefficient of thermal transfer, such as copper, aluminum or graphite, for example. Both solutions can also be applied simultaneously, thereby achieving optimal temperature transfer while at the same time providing greater rigidity to the leak-tight tank (2). The combination of both solutions is shown in FIG. 3.

For cold diffusion and the industrial or consumer application thereof, the system can adopt various solutions according to the application that is sough which are based on the principles of thermal convection or conduction.

Figure 4:
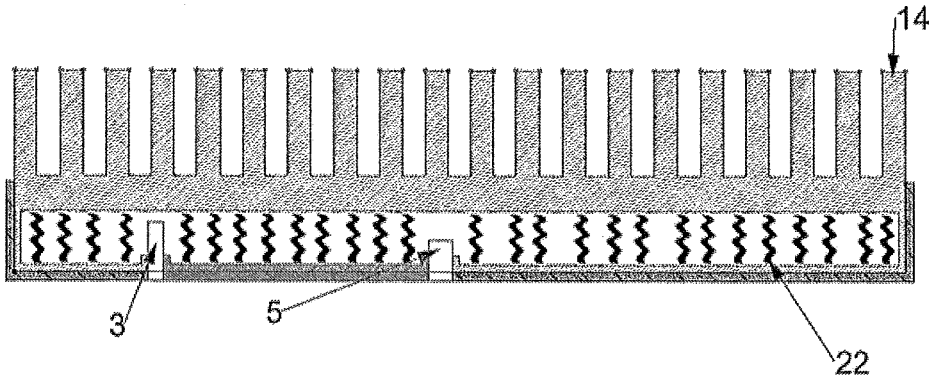
FIG. 4 shows a cross-section of the leak-tight tank with external fins.

FIG. 4 depicts the thermal convection solution. The leak-tight tank (2) will be provided with a plurality of external fins (14) located on the outside thereof for the purpose of increasing the temperature diffusing surface. This helps to optimize transferring the cold to the compartment or element to be cooled.

Figure 6:
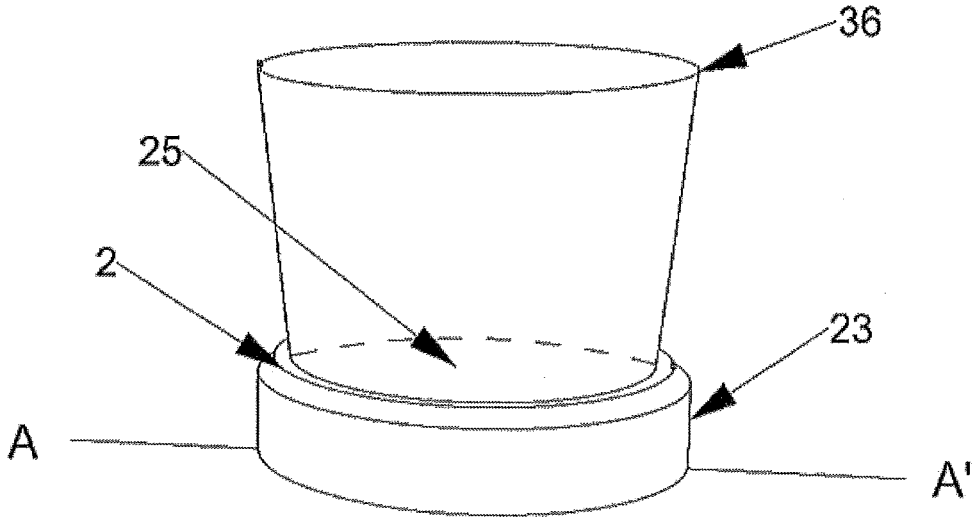
FIG. 6 shows another configuration of the refrigerating system applied to cooling small tanks.
Figure 9:
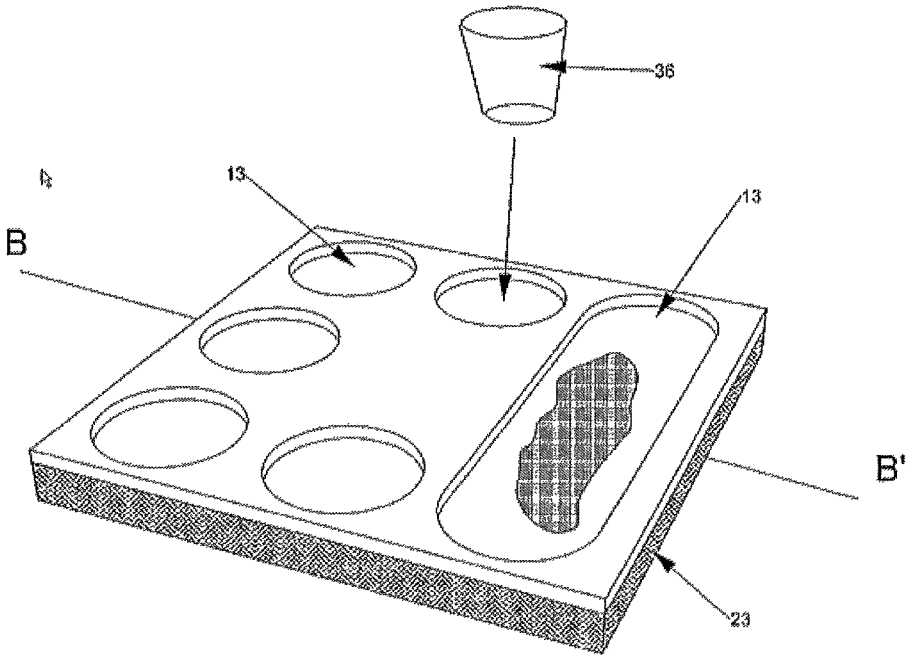
FIG. 9 shows an isometric perspective view of a configuration of the refrigerating system in the form of a tray, characterized by the arrangement of different refrigerating compartments.

In the case of using the thermal conduction solution, the substance object of cooling will be placed directly in contact with the leak-tight tank (2), as can be seen in FIG. 6. This leak-tight tank (2) may be provided with cavities or compartments (13) for the purpose of housing the substances to be refrigerated, or some type of receptacle with substances or elements to be refrigerated (as depicted in FIG. 9 for example).

Figure 11:
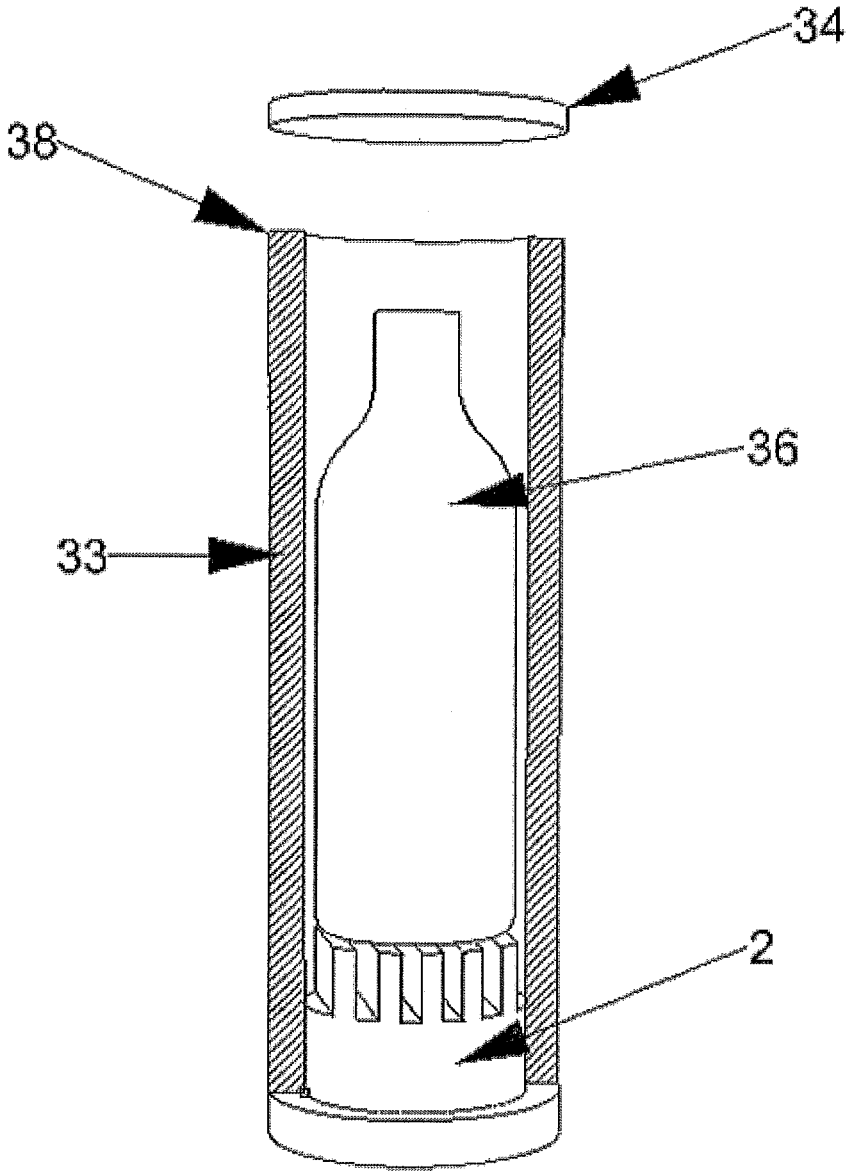
FIG. 11 shows an isometric perspective view of an application of the refrigerating system configured for a small isothermal rigid receptacle.

It is possible to combine both solutions (conduction and convection) according to the placement of the object to be cooled with respect to the vaporizer or leak-tight tank (2), as shown in FIG. 11.

Figure 5:
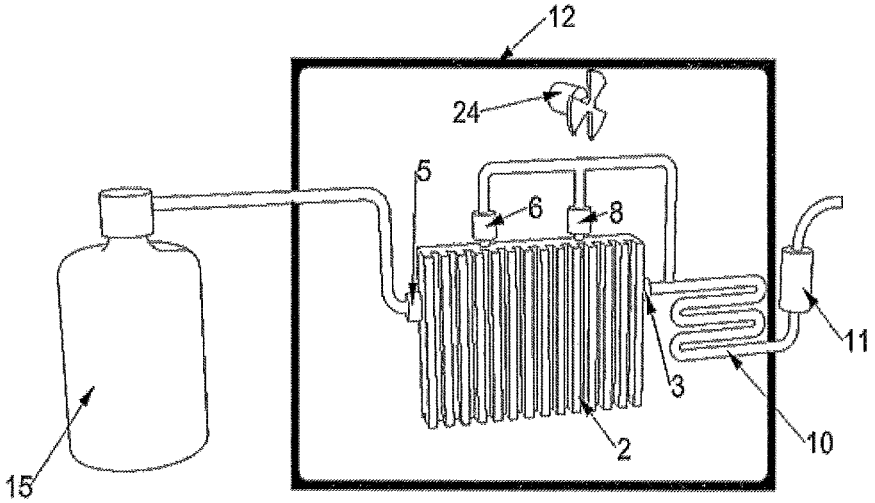
FIG. 5 shows an isometric perspective view of one of the configurations of the refrigerating system placed inside an isothermal receptacle.

FIG. 5 depicts the application of this controlled PLG evaporation system for isothermal refrigerating chambers or enclosures. A series of solutions which help optimize the cold generating capacity within the enclosure can be included. These two solutions, which can be complementary to one another, are thereby proposed:

Integration of a fan (24) inside the chamber, the purpose of which is to distribute the cold produced by the leak-tight tank (2) throughout the inside of the thermally insulated tank or isothermal enclosure (12). The fan can be operated either electrically or pneumatically, using the same pressure from evaporating the PLG (1) contained in the leak-tight tank (2) as a result of including a gas outlet arranged for such purpose.

Adaptation of a coil (10) made with a material having high thermal conduction. It can be placed at the outlet of the pressure control valve (3). It would take advantage of the residual cold generated in the process of evaporating the PLG (1). Alternatively, said coil could be placed directly at the outlet of the leak-tight tank (2), being connected at the other end thereof to the pressure control valve (3), performing the same diffusion function described in the first solution. In order to take advantage of all the refrigerating power of PLG (1) at the time of loading, the outlets of the evaporation control valve (3), purge valve (8) and loading valve (6) can be attached to one another.

Due to the possible use in closed areas or to simply prevent the release of PLG vapors into the atmosphere, a gas filter (11) can be added at the outlet of the system (i.e., at the outlet of the coil (10) or alternatively at the outlet of the valve evaporation control (3)). This can be made with any of the adsorbent materials existing on the market, such as activated carbon, molecular sieve, etc. This thereby assures that system operation is clean and not hazardous for the environment.

If the system is integrated or introduced in an isothermal enclosure (12), the gas must be given an outlet to the exterior for the purpose of preventing said gas exiting the system from being released inside same since the latter has absorbed part of the heat of the isothermal enclosure (12) so it would therefore introduce heat in the system again, causing a considerable reduction in output.

Additionally, a PLG source or refill bottle (15) connected to the filling valve (5) can be implemented in the refrigerating system. With the use of said refill bottle (15), the operating time of the refrigerating system could be extended. Once the PLG in the leak-tight tank (2) runs out, it could be refilled "in situ" as a result of said refill bottle (15). The loading system can be automated by installing electric, mechanical or pneumatic means acting on the filling valve (5). This filling valve (5) will gradually automatically fill the leak-tight tank (2) as the PLG (1) is consumed.

Today on the market there are small bottles designed for containing PLG (1), so operating time of the refrigerating system will simply depend on the number of refill bottles available.

Figure 7:
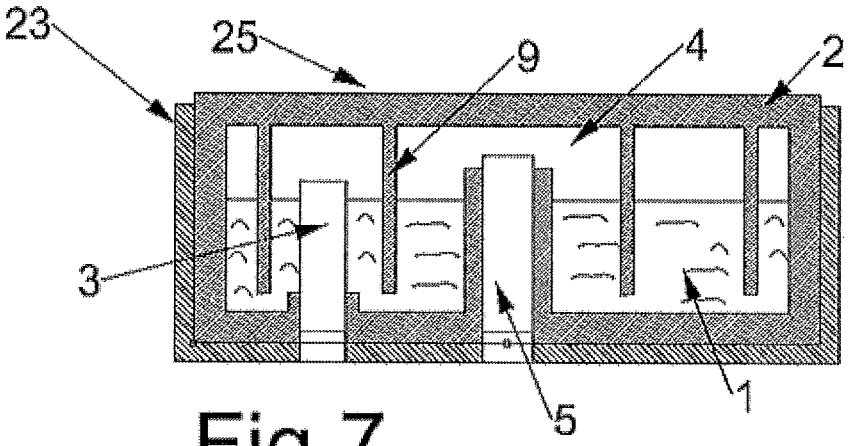
FIG. 7 shows section A-A' of FIG. 6, depicting an improvement optimizing temperature transfer due to the use of internal fins.
Figure 8:
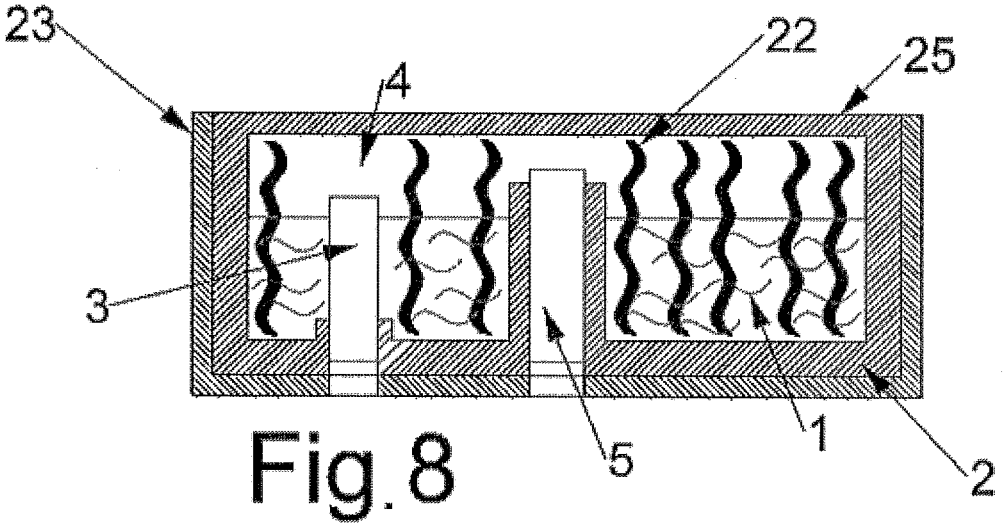
FIG. 8 shows section A-A' of FIG. 6, depicting an improvement optimizing temperature transfer due to the use of a mesh or foam for thermal transfer.

Another simpler configuration of the system according to the invention consists of the leak-tight tank (2) having only the filling valve (5) and the evaporation control valve (3) for the purpose of being applicable to small refrigerating containers (36), such as a glass. As a result of thermal conduction, the configuration transmits cold to said container (36) or material placed in contact with the surface (25) thereof. It could also directly cool liquids or solids placed therein, working in this case as a self-refrigerating container, as depicted in FIGS. 6, 7 and 8.

As previously mentioned, for the purpose of increasing the cold transmission surface for the transmission of cold through thermal conduction between the PLG (1) and the leak-tight tank (2) containing it, various solutions that are part of the object of the invention can be applied. One of them would be through the application of internal fins (9) arranged as seen in FIG. 7, which is section A-A' of FIG. 6. The other solution would consist of using a mesh or foam (22) made from a material with a high coefficient of thermal transfer, such as copper, aluminum or graphite, for example. This other configuration is depicted in FIG. 8, showing section A-A' of FIG. 6. Both solutions can be combined for greater thermal transmission efficacy.

Both solutions according to the invention have a filling valve (5), an evaporation control valve (3) and thermal insulation (23) surrounding the leak-tight tank (2) so that the highest refrigerating power is concentrated in the upper part of the system (25).

Figure 10:
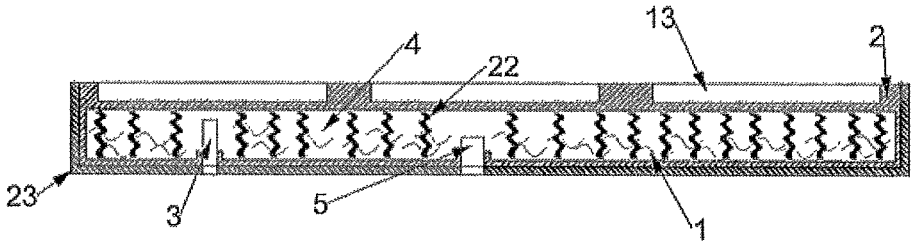
FIG. 10 shows section B-B' of FIG. 9 with the use of mesh or foam for thermal transfer.

Said portable refrigerating systems according to the invention can be configured in the form of a tray-container, as shown in FIG. 9. This configuration achieves a type of compartments (13) designed for placing different containers to be refrigerated. FIG. 10 depicts section B-B' of FIG. 9. As can be seen, the thermally conductive mesh (22) of FIG. 8 has been depicted instead of the internal fins (9) of FIG. 7, although both configurations are valid. It is possible to apply both solutions simultaneously, i.e., using a leak-tight tank (2) internally having both internal fins (9) and conductive mesh or foam (22).

Figure 12:
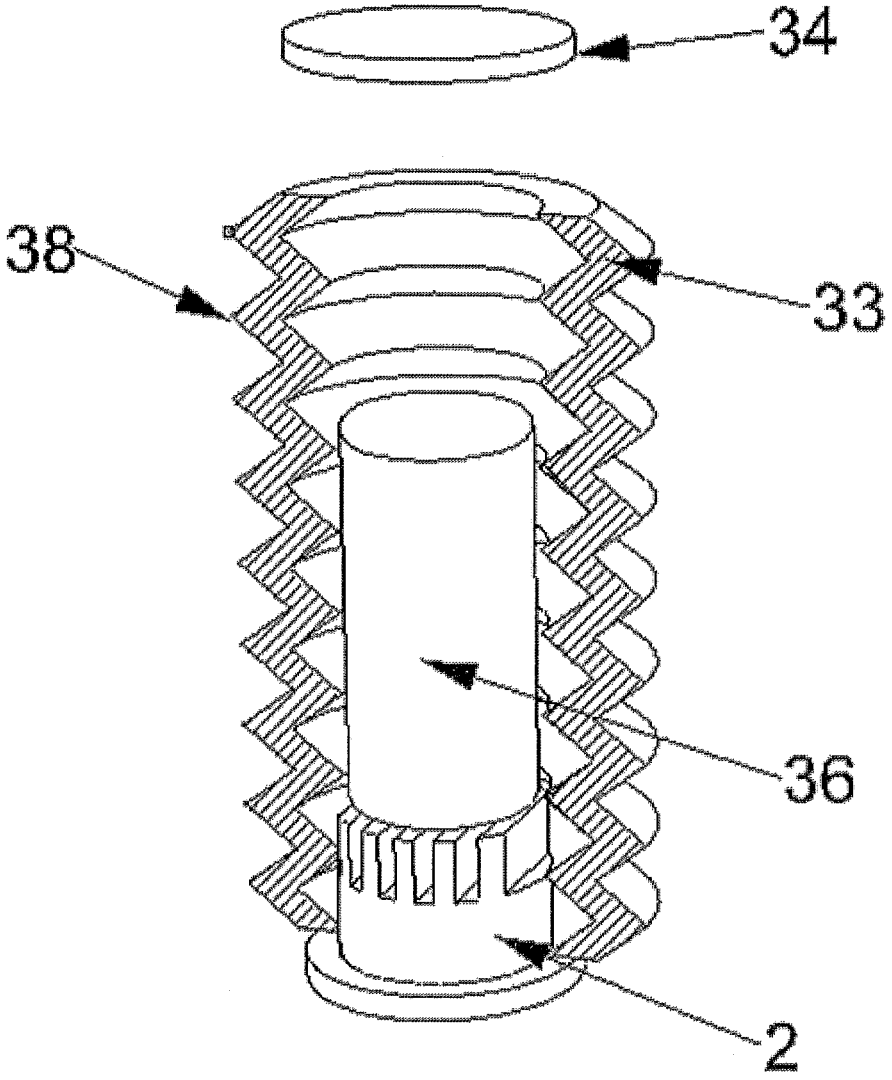
FIG. 12 shows an isometric perspective view of an application of the refrigerating system configured for a small folding isothermal receptacle.

Based on this refrigerating autonomous system according to the invention depicted in FIGS. 6, 7 and 8, another thermal backpack type configuration that is useful for refrigerating small containers, such as a bottle (36), can be created. FIG. 11 depicts a side section in which the refrigerating autonomous system (2), located inside a casing (38) having a filler (33) consisting of thermal insulation can be seen. The casing (38) has a cover (34) for being closed. This application keeps the tank or bottle (36) refrigerated for a long time period and has a relatively low weight. This application can therefore be used, for example, to transport isotonic drinks for athletes. As an extension and improvement to this refrigerating autonomous system, the casing (38) can be built such that it is folding, as depicted in FIG. 12. This same solution can be used, depending on the size of the insulating tank, for maintaining and conserving drugs and foods or other objects or substance susceptible to refrigerating. This example depicts the leak-tight tank (2) with external fins (14) although the system could work without them.

Figure 13:
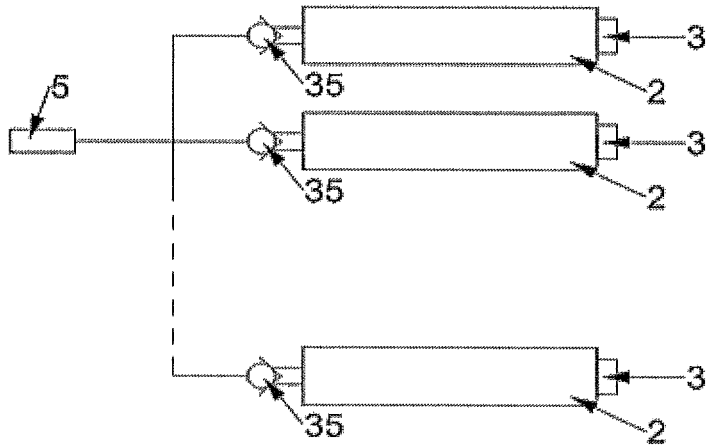
FIG. 13 shows a configuration of the refrigerating system characterized by the arrangement of different refrigerating levels.

This family of self-refrigerating trays-containers according to the invention can be built such that they contain different compartments and these compartments can in turn have different temperatures in a controlled manner. FIG. 13 shows the operating scheme. As can be seen, there are different leak-tight tanks (2) but they all have a common inlet valve (5) for the PLG (1) and they are provided with non-return valves (35) or another system performing the same function. With these valves, it is achieved that once the different leak-tight tanks (2) are loaded, there is no hydraulic communication between them. The different leak-tight tanks (2) integrated in the same structure will be provided with independent control valves (3), different temperature gradients being achieved in each leak-tight tank (2), and therefore different temperatures being achieved depending on the area in which the material to be refrigerated is located.

Figure 14:
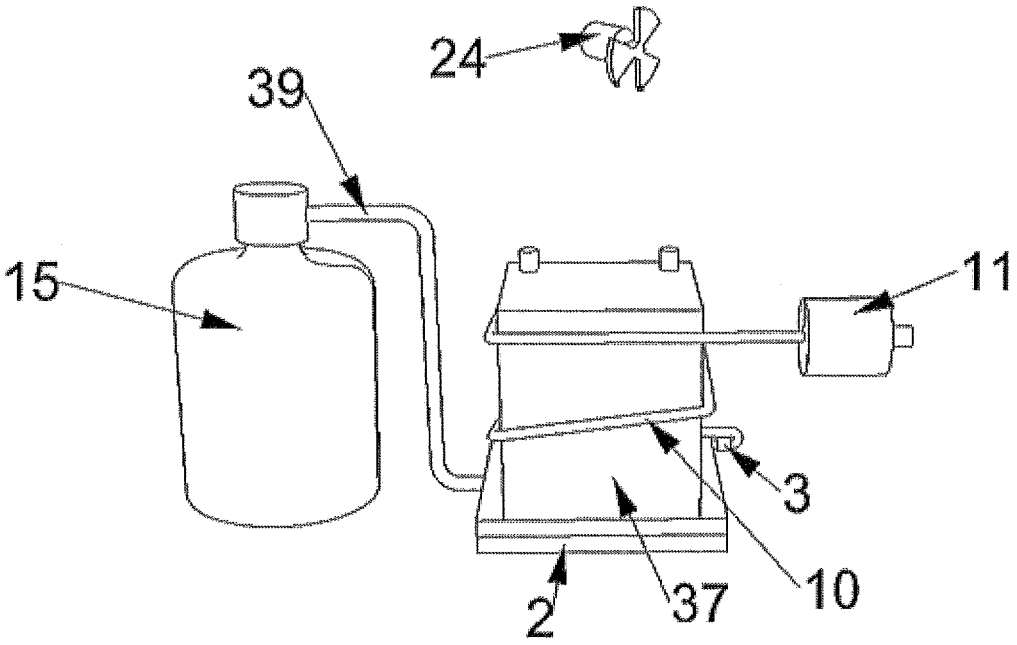
FIG. 14 shows an isometric perspective view of a configuration of the system for refrigerating batteries.

Based on what has previously been described, another configuration that is also part of the present invention is proposed in this case for maintaining the optimal operating temperature of batteries or energy accumulators (37) used in electric automotive systems and in uninterruptible power supply (UPS). Since said batteries (37) must provide enormous power in a short time period, they experience heating problems, so their output and service life are decreased. A possible scheme for said configuration is depicted in FIG. 14 (because it can be provided with different optimization elements, such as the coil, filter, etc., described above). What is depicted is described as follows: the battery to be refrigerated (37) is in contact with a leak-tight tank or evaporator (2). Said evaporator (2) is fed with PLG through the tube (39), which is in turn connected to the PLG refill tank (15). The temperature of the evaporator (2) is controlled by the valve (3). To optimize the refrigerating capacity of the system, it can be provided with a coil (10) and/or fan (24), the respective operations of which have previously been described in other configurations of the same system. Finally, if required by the use of this configuration, a gas filter (11) can additionally be used. This system can furthermore be integrated inside an isothermal enclosure (12).

Figure 15:
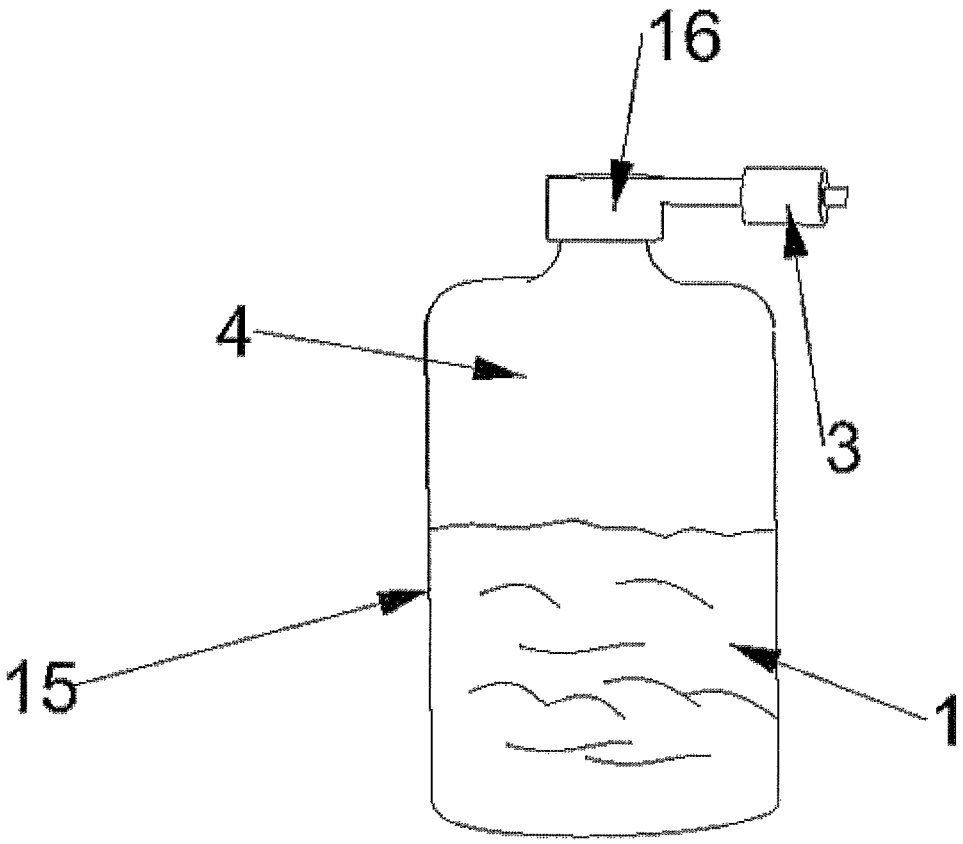
FIG. 15 shows a configuration of the refrigerating system characterized by the use of a bottle containing PLG from a commercial source, used directly as a vaporizer.

Another refrigerating solution according to the invention based on PLG evaporation for cooling a chamber or compartment consists of using a commercial PLG container (bottle) (15) as an evaporator, FIG. 15. The operation of said system is as follows: For the controlled evaporation of the PLG (1), an evaporation control valve (3) which can be activated by pressure, temperature or electromagnetic means is connected to the outlet adapter (16) of the commercial container (PLG source or bottle) (15). Said evaporation control valve (3) performs the function of controlling the outlet pressure of the evaporated gas and, accordingly, controls the temperature and pressure of the PLG contained inside the bottle (15). The cold produced by evaporation of PLG therefore cools the bottle (15), the bottle thereby performing the dual function of PLG receptacle and vaporizer.

Figure 16:
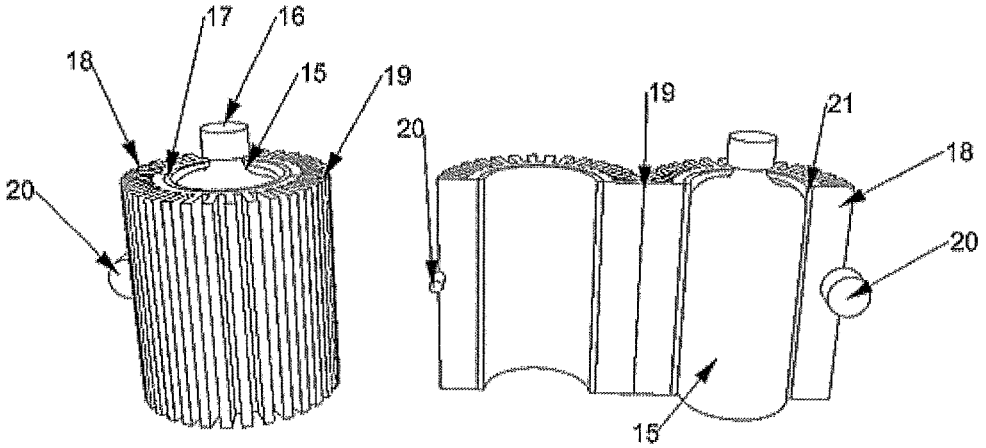
FIG. 16 shows a configuration of the refrigerating system characterized by the optimized use of the commercial bottle as a vaporizer as a result of using a fastening system configured in a series arrangement of fins on the outer face thereof.

An improved embodiment of the preceding description according to the invention is shown in FIG. 16. Said improvement consists of using a metal casing (17) provided with a plurality of external fins (18). This must be built from a material having a high coefficient of thermal conductivity (such as aluminum or copper). Use of these fins allows greater temperature transfer between the commercial pressurized liquefied gas container (PLG source or bottle) (15) and the compartment or container to be refrigerated.

For increasing thermal transfer, this system of casing (17) can also have a layer made from a flexible material (21) so that there can be greater thermal contact between the outside of the commercial container (bottle) (14) and the casing (17) provided with external fins (18). Said material could consist of a gel or rubber having a high coefficient of thermal conductivity.

This casing (17) with fins (18) will have an opening and closing system (20) which will allow it to be fixed firmly to the commercial pressurized liquefied gas container (bottle) (14) in order to replace it once it has been used up.

Figure 19:
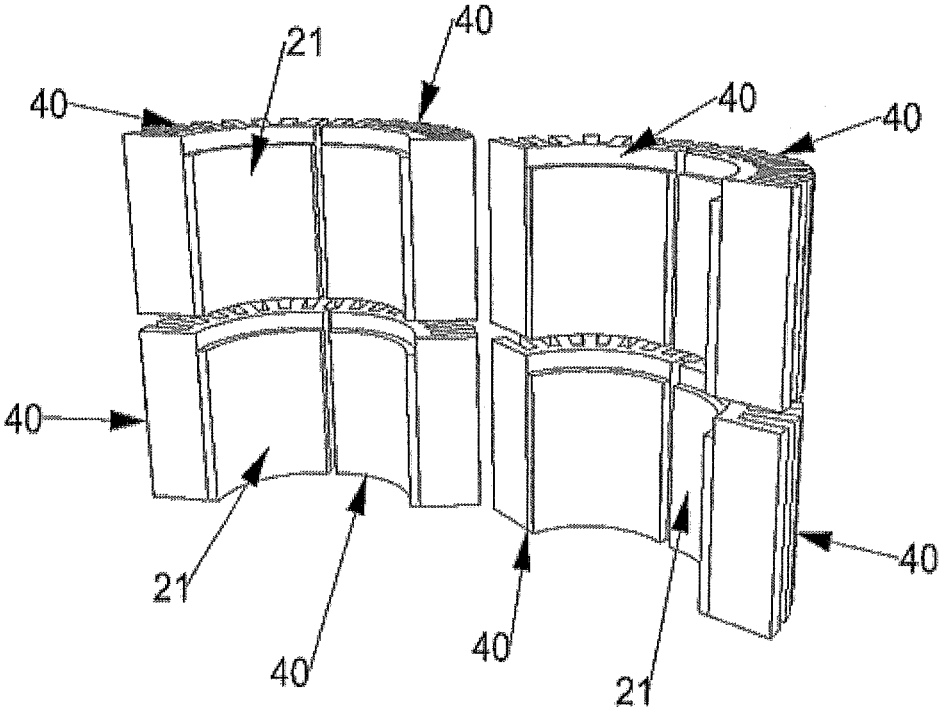
FIG. 19 shows a depiction of the modular construction of the casing with fins applied to a commercial container or bottle, performing vaporizer functions.

The casing (17) with fins (18) can be built with different configurations, such as with several pivoting systems (19) or hinges, for example, in order to be folded once it is not in use and thus take up less space. Alternatively, it could be built in a modular form, as shown in FIG. 19, such that modules could be added or removed depending on the different size of the commercial pressurized liquefied gas container (bottle) (14).

Figure 17:
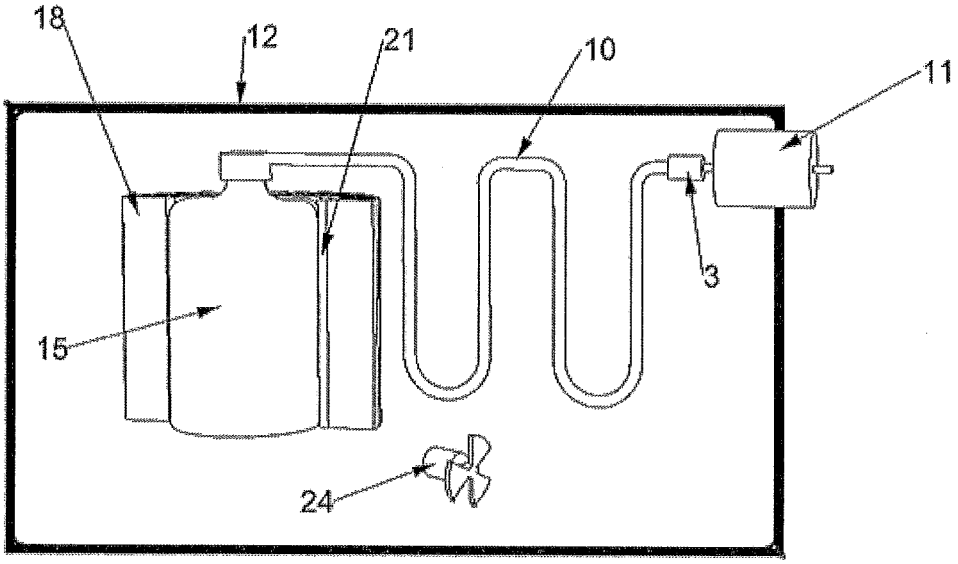
FIG. 17 shows a schematic depiction of the refrigerating system of FIG. 16 arranged in an isothermal enclosure, with the supplements of a coil, fan and outlet filter.

The application of said system according to the invention inside the compartment to be cooled or isothermal enclosure (12) is shown in FIG. 17. From this point, system operation is similar to that described for FIG. 1. To optimize the refrigerating capacity of the system, it can be provided with a coil (10) and/or a fan (24), the respective operations of which have previously been described in other configurations of the same system. Finally, if required by the use of this configuration, a gas filter (11) can additionally be used The different solutions proposed in the present invention can be used as emergency portable systems for conventional refrigerating systems as shown in FIGS. 5 and 17. Also, for cases of a supply failure of the sources of energy, an ad hoc system can be provided or preinstalled with this configuration according to the present invention. Said system according to the present invention allows maintaining the temperature of the compartment where it is located. This is useful, for example, for domestic and industrial refrigerators which, supplied by the power grid, in the event of a supply failure or breakdown, can be activated manually or automatically through a control system.

The operation of said devices according to the invention is similar to that described in FIG. 5, that described in FIG. 17 also being valid.

In turn, all the previously described solutions according to the invention are based on using a leak-tight tank (2) containing a PLG (1) which is used as a vaporizer as a result of the principle of the controlled evaporation of said PLG. Said solutions can be susceptible to scaling depending on refrigerating needs.

Figure 18:
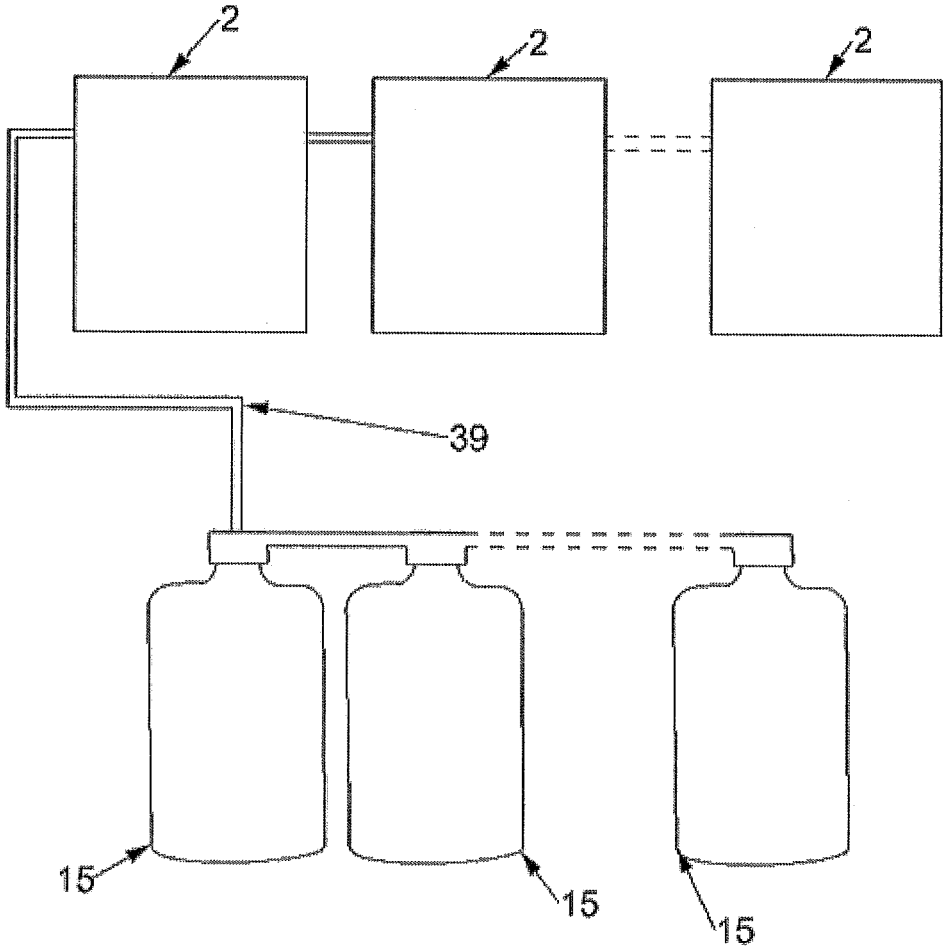
FIG. 18 shows a schematic depiction of the modular construction of the leak-tight tanks or evaporators and of the interconnection system between the different evaporators.

Within this concept, a practical solution according to the invention which complies with said scalability capacity is described. It consists of a modular construction of leak-tight tanks or evaporators (2), as can be seen in FIG. 18, which will be provided with a system which allows the interconnection (39) between different evaporators (2). To provide greater autonomy to all the systems herein described, they can be provided with more than one commercial container or bottle (15) arranged in parallel. This solution achieves a greater supply of PLG, and therefore greater operating autonomy.

Although the invention has been described only in relation to the embodiments mentioned herein, it must be understood that other possible combinations, variations and improvements would also be included within its scope of protection, which is defined exclusively by the attached claims.

What is claimed is:

1. A portable self-refrigerating autonomous system, comprising a leak-tight tank in which a pressurized liquefied gas (PLG) is stored, at least one evaporation control valve and a filling valve, all the valves being connected to the leak-tight tank;

wherein said at least one evaporation control valve cooperates with a pressure sensor and an actuator intended for controlling the opening of said evaporation control valve, such that the evaporation level of the PLG which the actuator allows depends directly on the pressure detected by said sensor, thereby controlling the pressure and the internal temperature in the leak-tight tank; and wherein the system further contains a discharge control valve and a tube connected to one another; said tube having a given length and being arranged, at least in part, inside the leak-tight tank, and said discharge control valve being able to be activated by means of a level sensor, so that the discharge control valve, the tube and the level sensor allow the filling valve to fill PLG inside the leak-tight tank up to a loading value.

2. The portable self-refrigerating autonomous system according to claim 1, wherein said filling valve and said at least one evaporation control valve are arranged in series on one and the same conduit or adapter.

3. The portable self-refrigerating autonomous system according to claim 1, wherein said system comprises a purge or forced refrigeration start-up valve, intended for causing the sudden evaporation of the PLG and the purging of residual gas resulting from the evaporation of the PLG, thereby allowing an immediate cooling of the leak-tight tank.

4. The portable self-refrigerating autonomous system according to claim 1, wherein said system comprises in the inner walls of the leak-tight tank a system of internal fins made of a temperature-conducting material and intended for improving the transmission of cold between the PLG and the leak-tight tank.

5. The portable self-refrigerating autonomous system according to claim 1, wherein said system comprises an automatic or manual loading system consisting of a filling valve and an external filling bottle which will gradually automatically fill the leak-tight tank as the PLG is being used up.

6. The portable self-refrigerating autonomous system according to claim 1, wherein a coil is located either at the outlet of the evaporation control valve or between the leak-tight tank and the evaporation control valve which allows improving diffusion of the cold that is generated.

7. The portable self-refrigerating autonomous system according to claim 6, wherein a gas filter is arranged at the outlet of the coil, or at the outlet of the evaporation control valve, preventing direct diffusion of gas resulting from the evaporation of the PLG into the atmosphere.

8. The portable self-refrigerating autonomous system according to claim 1, wherein said system is integrated in an isothermal container, and in that said system has a gas exhaust system for evacuating gas resulting from the evaporation of the PLG to the exterior of said isothermal container.

9. The portable self-refrigerating autonomous system according to claim 1, wherein said system has at least one compartment in thermal contact with the leak-tight tank, intended for housing receptacles with substances or elements to be refrigerated.

10. The portable self-refrigerating autonomous system according to claim 9, said system is integrated in a rigid or folding isothermal enclosure provided with a closure system.

11. The portable self-refrigerating autonomous system according to claim 8, wherein the leak-tight tank has a plurality of thermally conductive fins on an outside surface of the leak-tight tank.

12. The portable self-refrigerating autonomous system according to claim 1, wherein the leak-tight tank further comprises inner walls and a system of meshes or foams made of temperature-conducting material and arranged between said inner walls.

13. The portable self-refrigerating autonomous system according to claim 8, wherein said system comprises a fan or turbine operated by electricity or pneumatically, intended for distributing the cold produced at the exterior of the leak-tight tank throughout the inside of the thermally insulated container.

14. A cooling arrangement comprising a plurality of portable self-refrigerating autonomous systems according to claim 1, wherein the leak-tight tanks of said systems are interconnected to one another.

* * * * *